US008154000B2

(12) United States Patent
Hergenhan et al.

(10) Patent No.: US 8,154,000 B2
(45) Date of Patent: Apr. 10, 2012

(54) ARRANGEMENT FOR THE CONTINUOUS GENERATION OF LIQUID TIN AS EMITTER MATERIAL IN EUV RADIATION SOURCES

(75) Inventors: Guido Hergenhan, Grossloebichau (DE); Diethard Kloepfel, Heidegrund (DE); Todd Byrnes, Frankfurt (DE); Elma Weber, Wuerselen (DE); Mike Möritz, Jena (DE)

(73) Assignee: XTREME technologies GmbH, Aachen (DE)

( * ) Notice: Subject to any disclaimer, the term of this patent is extended or adjusted under 35 U.S.C. 154(b) by 211 days.

(21) Appl. No.: 12/773,148

(22) Filed: May 4, 2010

(65) Prior Publication Data

US 2010/0282987 A1 Nov. 11, 2010

(30) Foreign Application Priority Data

May 8, 2009 (DE) ..... 10 2009 020 776

(51) Int. Cl.
*H05G 2/00* (2006.01)

(52) U.S. Cl. ..... 250/504 R; 250/503.1; 250/493.1

(58) Field of Classification Search ..... 250/504 R
See application file for complete search history.

(56) References Cited

U.S. PATENT DOCUMENTS 7,122,816 B2 10/2006 Algots et al.
7,385,211 B2 6/2008 Derra et al.
7,405,416 B2 * 7/2008 Algots et al. ..... 250/493.1
7,705,333 B2 * 4/2010 Komori et al. ..... 250/504 R
2007/0085044 A1 4/2007 Hergenhan et al.

FOREIGN PATENT DOCUMENTS

DE 10219173 A1 11/2003

* cited by examiner

*Primary Examiner* — Phillip A Johnston
(74) *Attorney, Agent, or Firm* — Houston Eliseeva LLP

(57) ABSTRACT

The invention is directed to an arrangement for generating EUV radiation based on a hot plasma using liquid emitter material. The object of the invention is to find a novel possibility for generating EUV radiation which allows a continuous supply of liquid, particularly metal, emitter material (2) under a defined high pressure without having to interrupt the continuous supply of emitter material (2) when consumed emitter material (2) must be replenished. According to the invention, this object is met in that the emitter material supply unit (4) has at least a first pressure vessel (44) and a second pressure vessel (44') between the reservoir vessel (41) and the injection device (5) for generating a high emitter material pressure for the injection unit (5), the pressure vessels (44, 44') are acted upon by a high-pressure gas system (73) with a gas pressure (74) in the megapascal range, and the emitter material supply unit (4) has means for switching the high-pressure gas system (73) from one pressure vessel (44, 44') to the other pressure vessel (44, 44') and for correspondingly alternately switching the injection unit (5) to the constant emitter material pressure of the respective pressure vessel (44, 44') being pressurized, wherein at least one of the pressure vessels (44, 44') can be refilled during the continuous operation of droplet generation and plasma generation.

23 Claims, 6 Drawing Sheets

ARRANGEMENT FOR THE CONTINUOUS GENERATION OF LIQUID TIN AS EMITTER MATERIAL IN EUV RADIATION SOURCES

RELATED APPLICATIONS

This application claims priority to German Patent Application No. DE 10 2009 020 776.7, filed May 8, 2009, which is incorporated herein by reference in its entirety.

FIELD OF THE INVENTION

The invention is directed to an arrangement for generating EUV radiation based on a hot plasma using liquid emitter material and having an emitter material supply unit containing at least one reservoir vessel for emitter material, an evacuated interaction chamber in which a focused, pulsed energy beam is directed to an interaction point, and an injection device for reproducibly supplying droplets of emitter material at the interaction point so as to be synchronized with the pulsed energy beam in order to convert the droplets into hot plasma for EUV emission.

The invention is applied in gas discharge sources (GDP) and laser plasma sources (LPP) and for electrode coating in combined EUV sources which are used particularly for semiconductor lithography.

BACKGROUND OF THE INVENTION

It has recently been shown that the radiation outputs which were previously still inadequate for semiconductor lithography in the extreme ultraviolet spectral region around 13 nm can obviously be substantially further increased only by means of more efficient emitter substances such as tin or lithium or combinations thereof (DE 102 19 173 A1). DE 102 19 173 A1 also already makes reference to the technical problem that very high temperatures of the discharge source are required for evaporation when using metal emitters, and condensation of the metal vapors in the interior of the sources must be prevented because otherwise operational failure can be expected within a short time. With an electric discharge, another problem arises in that the electrodes take on such high temperatures due to the high currents and the direct proximity to the plasma that the high-melting electrode material (e.g., tungsten) is loaded near the melting point, and other emitter material which is not provided directly in the excitation site for plasma generation is also evaporated and generates an unwanted debris component.

When tin is supplied in the form of gaseous tin compounds, e.g., $SnCl_4$, there is the added disadvantage that more emitter material is introduced into the discharge chamber than is necessary for the EUV emission process. As a result of condensation, these residual amounts lead to deposits of tin layers and—when using $SnCl_4$—chlorides which cause the source to fail after a relatively short operating period.

An important approach to a solution for preventing excess emitter material in the plasma chamber of the pulsed radiation source is to make available for every pulse only as much emitter material as can be completely converted into radiating plasma through the input of energy (through electric discharge (GDP), laser beam (LPP) or electron beam) for generating the plasma at the excitation site.

When metal emitter material is supplied as a regular series of liquid droplets which is generated through a nozzle under a certain pressure or is directed to the electrodes for coating, the nozzle must be connected to a reservoir of liquid emitter material. In so doing, it is necessary to interrupt the supply of emitter material to the nozzle in order to fill the reservoir because the pressure level for the constant generation of droplets does not remain the same while the reservoir is being filled.

While stationary electrodes reach a surface temperature above the melting temperature of the electrode material itself (3650 K for tungsten in any case) after a few pulses at repetition rates in the kilohertz range, an equilibrium temperature can be kept low enough by rotating the electrode that even the temperature peaks on the electrode surface remain appreciably below the melting temperature of tungsten. The temperature peaks are still far above the melting temperature of the emitter material (505 K for tin) so that, in addition to the controlled laser evaporation, there is an uncontrolled deposition of tin on the electrodes.

To prevent uncontrolled evaporation of emitter material, US 2007/0085044A1 discloses a device for generating extreme ultraviolet radiation with rotating electrodes in which an injection device injects a series of individual volumes of emitter material in a discharge area of the rotating electrodes at a defined distance from the latter. An energy beam is directed to the site in the discharge area where the individual volumes arrive so as to be synchronized with the frequency of the gas discharge for the plasma generation so that they are successively pre-ionized by the energy beam. To this end, the injection device is designed in such a way that the individual volumes are supplied at a repetition frequency that is adapted to the frequency of the gas discharge. However, this has the drawback that no measures are provided for ensuring constant droplet generation.

For stable generation of radiation from a series of droplets (low pulse-to-pulse fluctuations and no outages), every droplet must be supplied at the desired repetition rate at a location at a distance (typically 50-1000 mm) from the nozzle. This demands a very stable generation of droplets, i.e., constant droplet size, flight direction, and droplet velocity. This necessarily calls particularly for a very constant, regulated pressure of the emitter material in the droplet generator (in the nozzle).

The adjustment of a suitable pressure for a liquid emitter material can be carried out by applying a pressure gas to the liquid as is described, e.g., in U.S. Pat. No. 7,122,816 B2. In particular, a determined pressure is maintained in the droplet generator and also in an emitter material reservoir. A connection line with a controllable valve is provided between the two vessels so that the droplet generator can be refilled during the course of operation and so that a controlled melting of solid emitter material in the emitter material reservoir, depending on the amount of emitter material delivered to the droplet generator, can always be kept on hand at the same time and to make refilling possible also while the droplet generator is operating.

However, the commercially available pressure regulator used for this purpose to adjust and regulate a defined gas pressure does not solve the problem which arises when gas at elevated pressure is applied to a liquid metal emitter material such as tin due to the solubility of the gas (mixing of the liquid) in the liquid metal.

SUMMARY OF THE INVENTION

It is the object of the invention to find a novel possibility for generating EUV radiation which allows a continuous supply of liquid, particularly metal, emitter material under a defined high pressure without having to interrupt the continuous supply of emitter material when consumed emitter material must be replenished.

Further, the dissolution of pressure gas in the emitter material which occurs when pressure is applied during the continuous and constant supply of emitter material is reduced or prevented.

When liquid metal is used as emitter material, a further object consists in preventing corrosion particularly during the refilling process (replenishment of consumed emitter material).

In an arrangement for generating EUV radiation based on a hot plasma using liquid emitter material and having an emitter material supply unit containing at least one reservoir vessel for emitter material, an evacuated interaction chamber in which a focused, pulsed energy beam is directed to an interaction point, and an injection device for reproducibly supplying droplets of the emitter material at the interaction point so as to be synchronized with the pulsed energy beam in order to convert the droplets into hot plasma for EUV emission, the above-stated object is met according to the invention in that the emitter material supply unit has at least a first pressure vessel and a second pressure vessel between the reservoir vessel and injection device for generating a high emitter material pressure for the injection unit, in that the pressure vessels are acted upon by a high-pressure gas system with a gas pressure in the megapascal range in order to maintain a permanent, constant emitter material pressure in the injection device, and in that the emitter material supply unit has means for switching the high-pressure gas system from one pressure vessel to the other pressure vessel and for correspondingly alternately switching the injection unit to the constant emitter material pressure of the respective pressure vessel being pressurized, wherein at least one of the pressure vessels can be refilled with emitter material from the reservoir vessel during the continuous operation of droplet generation and plasma generation.

Further, the emitter material supply unit is advantageously connected to a vacuum system which is selectively connected to at least one of the pressure vessels that is not enabled for the high-pressure gas system in order to fill the pressure vessel with emitter material from the reservoir vessel. In so doing, the vacuum system in the emitter material supply unit is advisably connected to the reservoir vessel to allow the reservoir vessel to be filled from different sources. The reservoir vessel can be filled by sucking in liquid emitter material from the outside or from a recycling vessel or can be filled by sucking in solid emitter material from the outside.

Further, the emitter material supply unit is advisably connected to a low-pressure gas system which is selectively connected to the reservoir vessel or to the recycling vessel to transfer emitter material from the reservoir vessel to one of the pressure vessels or to fill it with recycled emitter material.

The low-pressure gas system is preferably filled with inert gas in order to counter oxidation of the emitter material.

Fill level sensors are advantageously provided in the emitter material supply unit for measuring the fill level of at least the pressure vessels, which fill level sensors control a timely switching of the pressurization of the emitter material from one of the pressure vessels to another pressure vessel and initiate the filling of the respective empty pressure vessel. Various types of fill level sensors can be used.

In a first advantageous construction, the fill level sensor is constructed as a dynamometer so that the fill level can be determined based on the weight of the respective vessel, the respective vessel being suspended at the dynamometer and having flexible connection lines.

In a second variant, the fill level sensor is constructed as a strain gauge, the vessel being suspended at the free end of a flexural spring which is fixedly clamped at one side and provided with the strain gauge and having flexible connection lines, and the fill level can be determined based on the weight of the respective vessel and the strain of the strain gauge.

In a third embodiment form, the fill level sensor is constructed as an inductive fill level measuring device comprising two external cylinder coils.

In a fourth embodiment, the fill level sensor is a resistance wire, and the vessel that is filled with the metal emitter material serves as an electric line to the resistance wire which is arranged vertically in the vessel so as to be electrically insulated.

In a fourth construction, the fill level sensor is designed as a capacitive fill level measuring device with resistance wire, coupling electrode, and collector path, wherein the coupling electrode, which is shaped as an annulus, is moved along with the liquid level of the emitter material so as to float around the resistance wire and the collector path.

According to a sixth embodiment form, the fill level sensor has two electrically insulated contacts of different length, the electric contacts being closed by means of the metal emitter material at different fill levels to indicate a minimum and maximum fill level.

The emitter material supply unit can advantageously have separating means inside the pressure vessel for separating the emitter material from the pressure gas, which reduces the dissolution of pressure gas in the emitter material.

The separating means can advantageously be a barrier layer which is preferably formed by a viscous cover oil.

A second possibility for realizing separating means is a piston which can move up and down in a cylindrical pressure vessel.

In a third embodiment form, the separating means are formed as a flexible membrane between the emitter material and the pressure gas. The flexible membrane can advantageously be formed as convoluted or corrugated bellows which are filled with pressure gas and which displace the emitter material in the pressure vessel, or the flexible membrane, as convoluted or corrugated bellows (464), is filled with emitter material and is compressed by the pressure gas. In this connection, the convoluted or corrugated bellows are preferably constructed as metal bellows.

The basic idea behind the invention is that a constant, appropriately high pressure of the emitter material is required at the nozzle aperture for generating a stable, reproducible droplet stream for plasma generation in an EUV source, which can be carried out in a known manner by applying a pressure gas on the order of 1 to 50 MPa. However, according to Henry's law, the proportion of dissolved gas in the liquid material increases in proportion to the gas pressure. This proportion of dissolved gas causes a considerable problem when liquid emitter material is injected into the vacuum chamber. When the liquid emitter material exits from the nozzle under vacuum, the ambient pressure of the free liquid jet suddenly drops to virtually zero. Therefore, it is much easier for the dissolved gas to escape from the emitter material and bring about a considerable instability in droplet generation in the region of the nozzle, i.e., between the nozzle aperture and the point at which the continuous jet breaks up into droplets, which no longer allows for a stable generation of radiation.

Therefore, the invention provides steps for preventing or substantially hindering the absorption of gas in liquid, particularly metal, emitter materials while nevertheless allowing a high pressurization of the emitter material in different reservoir vessels and recycling vessels while generating the emitter stream in an uninterrupted and stable manner even during the replenishment of the consumed emitter material.

The solution according to the invention makes it possible to realize a stable generation of EUV radiation through constant droplet generation for interacting with a pulsed energy beam by ensuring an uninterrupted pressurization of liquid, particularly metal, emitter material at a defined high pressure without having to interrupt the continuous supplying of emitter material when replenishing consumed emitter material.

Further, the dissolving of pressure gas in the emitter material which occurs when acted upon by pressure is prevented or at least sharply reduced during the continuous, constant supplying of emitter material. Further, the invention prevents corrosion in the emitter material during the refilling of emitter material in the form of liquid metal.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
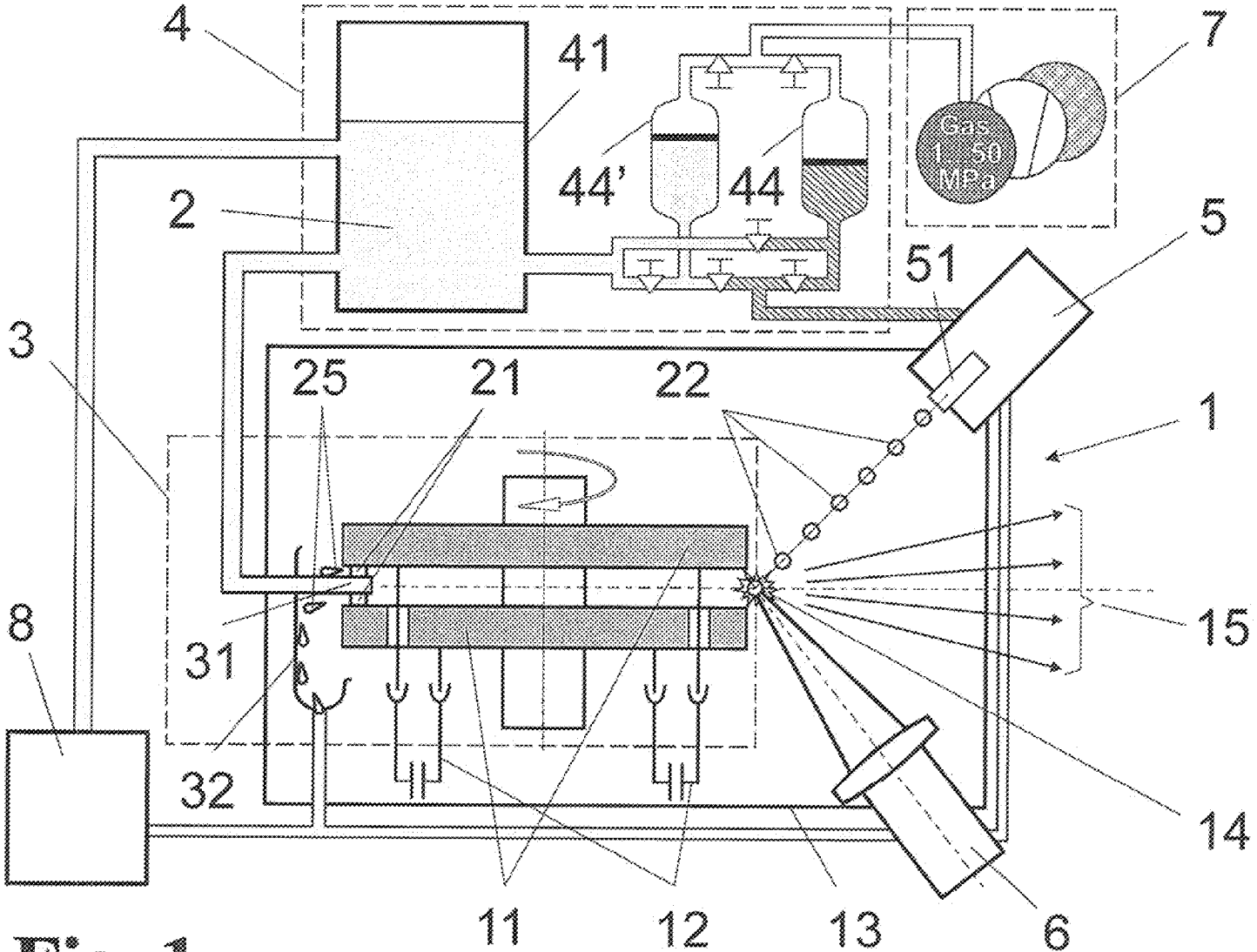
FIG. 1 shows a schematic view of the overall system for plasma-based radiation generation with regenerative electrode coating.

As is shown in FIG. 1, an arrangement for generating EUV radiation 15 based on a hot plasma 14 basically contains an EUV source module 1 in which a complete ionization of an emitter material 2 takes place inside an interaction chamber 13 to form an approximately punctiform hot plasma 14 for emitting EUV radiation 15 from the plasma 14.

The emitter material 2 for the radiation-emitting plasma 14 is supplied in the form of droplets 22 which are directed to a site for the desired plasma generation by an injection device 5 regardless of any additionally selected main process for plasma generation which can be carried out by electric discharge, laser beam, electron beam, ion beam, microwave or inductive excitation.

As in purely laser-induced, plasma-based radiation sources, the energy for heating the emitter material 2 in the form of droplets is introduced by means of a pulsed energy beam 6 which interacts with the successively injected droplets 22.

In the example shown in FIG. 1, without limiting generality, the energy for the main excitation process for the emitter material 2 is introduced through electric discharge in that rotating electrodes 11 which are connected to a discharge circuit 12 are arranged opposite one another in an interaction chamber 13 with a vacuum pressure between $10^{-1}$ and 50 Pa (preferably around 1 Pa).

To protect the electrodes 11 from erosion caused by the high-current discharge, the edge of the electrodes 11 is coated regeneratively with liquid emitter material 2 (preferably metallic tin or lithium). Coating is carried out by continuous spraying of liquid emitter material 2 on the edge of every rotating, disk-shaped electrode 11 through a two-sided coating nozzle 31.

The energy beam 6 which impinges on a droplet 22 of the synchronized series of droplets 23 of emitter material 2 in the vicinity of the edges of the electrodes 11 initiates the discharge and localizes the path of the discharge between the electrodes 11. It is preferably a laser beam but can also be an electron beam or ion beam. The emitter material 2 from the emitter material supply unit 4 is supplied to the injection device 5 for generating the series of droplets 23 which is synchronized with the pulse frequency of the energy beam 6. The injection device 5 comprises a nozzle 51 which ejects a jet of emitter material 2 under high pressure which breaks up into a regular series of droplets 22 (shown only in FIG. 12) after only a few millimeters due to a special effect of the nozzle 51.

Emitter material 2 that cannot be utilized during the plasma generation, whether in the form of excess droplets 24 which are generated too close together for hydrodynamic reasons or emitter material 25 (shown only in FIG. 1) flying off from the electrodes 11, is collected and returned in a recycling device 8 of the emitter material supply unit 4. Like the supply of droplets 22, the liquid emitter material 2 needed for coating is made available from a reservoir vessel 41 provided in the emitter material supply unit 4. The double-sided coating nozzle 31 sprays the edges of the rotating electrodes 11. Owing to the rotational movement, there remains a thin film of adhering emitter material 2 which is partially evaporated during the discharge.

However, a large part of the applied emitter material 2 is spun off again during the rotation of the electrodes 11. The emitter material 25 flying off from the rotating electrodes 11 is captured in a collecting vessel 32 and is likewise returned to the emitter material supply unit 4 via the recycling device 8.

Figure 2:
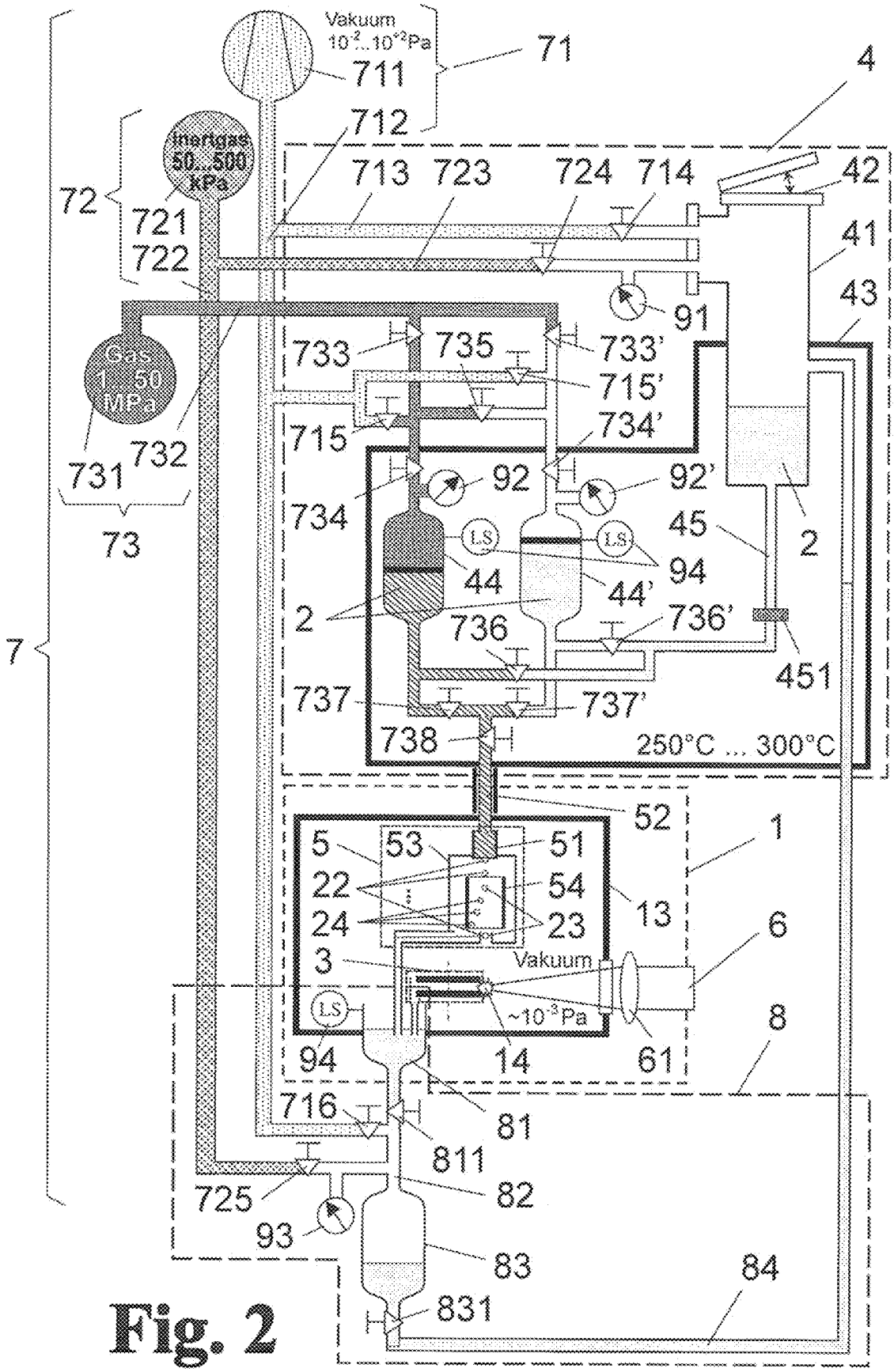
FIG. 2 shows an embodiment example of the invention for the continuous (uninterrupted) operation of EUV-radiation generation for plasma generation from liquid emitter material by laser-initiated electric discharge.

FIG. 2 shows a special construction for supplying a liquid metal emitter material 2 and for coating the electrodes 11 as well as for supplying mass-limited droplets 22 in a temporally defined manner for excitation by means of an energy beam 6. In this connection, it is very important to ensure that no emitter material is supplied in excess of the amount that can actually be converted into radiation by introduction of pulsed energy through the energy beam 6 and electric discharge. Excess emitter material 2 (excess droplets 24 or spun-off emitter material 25), which—without limiting generality—will be metallic tin (Sn) in the present example, would unnecessarily increase debris production.

In a plasma 14 induced by an energy beam, a droplet 22 (as mass-limited target) is excited in each instance by an energy radiation pulse. In the following, without limiting generality, the pulsed energy beam 6 will be a pulsed, focused laser beam.

When a stream of emitter material 2 is generated as a periodic sequence of droplets 22 in which more droplets 22 are generated than can be impacted by the series of pulses of the energy beam 6 of the focused laser (not shown) because of the manner in which the droplets 22 are supplied, excess droplets 24 which cannot be utilized and which would pass the interaction site of the energy beam 6 between pulses must be removed from the interaction chamber 13 or, prior to this, already in a preceding droplet separation chamber 54 of the injection device 5. This excess emitter material 24 can be salvaged by recycling and returned once again to a circuit of the emitter material supply unit 4.

On the other hand, for continuously operating plasma generation and radiation generation, the consumed emitter material 2 which the emitter material circuit loses to the plasma generation process must be replenished by supplying new material to the circuit cyclically without interrupting the continuity of the supplied flow of emitter material.

In order to generate the synchronized series of droplets 23 which are injected into the interaction chamber 13 from the emitter material injection device 5 at high speed (exit speed of 20 to 150 m/s), the liquid emitter material 2 must be made available in the nozzle 51 under high pressure (fluid pressure of 1 to 50 MPa). Maintaining this high pressure without interruption also during the process of refilling with emitter material 2 presents a special challenge.

However, when the emitter material 2 is pressurized by means of technical gases, which is simple in itself, the contact of gas with a liquid emitter material 2 (e.g., molten metallic tin) under high pressure imposes even greater demands because of additional requirements such as preventing corrosion and dissolving of the gases in the metal.

Filling Process

The emitter material 2 is introduced into the reservoir vessel 41 in solid or liquid form via a feed opening 42 which can be closed so as to be tight against gas. At least the bottom portion of the reservoir vessel 41 is located inside a heating chamber 43 which keeps all parts of the emitter material supply unit 4 at a temperature above the melting temperature of the emitter material 2, e.g., 232° C. for tin.

The feed opening 42 is subsequently closed and certain valves in the pressure system 7 for the emitter material 2 are closed or opened as follows.

The low-pressure valve 724 is closed at the low-pressure line 722 between the low-pressure gas supply 721 and the reservoir vessel 41. At the same time, the first emitter material inlet valve 736 and the second emitter material inlet valve 736' are closed between the reservoir vessel 41, a first pressure vessel 44 and a second pressure vessel 44', and the recycling vessel return-flow valve 831 in the recycling return line 84 to the reservoir vessel 41 is closed.

The vacuum valve 714 in the vacuum line 712 coming from the vacuum system 71 is then opened in order to suck out the oxygen which was entrapped during the filling process. The solid emitter material 2, if any, is melted by activating the heating chamber 43.

When a predetermined final vacuum pressure ($10^{-2}$ to $10^{+2}$ Pa) determined by means of a pressure sensor 91 is reached in the reservoir vessel 41, the vacuum valve 714 to the reservoir vessel 41 is closed.

In continuous operation, the two pressure vessels 44 and 44' are alternately refilled or kept under high pressure (1 to 50 MPa) so that a uniformly high pressure is transmitted in the emitter material injection device 5 from the high-pressure gas system 73 to the liquid emitter material 2 in the nozzle feed line 52.

In order to fill the first pressure vessel 44 with emitter material 2, the vacuum valve 715 and the pressure switching valve 734 of the first pressure vessel 44 are opened while the high-pressure valve 733 is closed and the first pressure vessel 44 is accordingly evacuated.

When a predetermined final pressure measured by the associated pressure sensor 92 is reached, the vacuum valve 715 and the pressure switching valve 734 are closed again. The outlet valve 737 of the first pressure vessel 44 is closed when the first pressure vessel 44 is to be filled.

To allow the emitter material 2 to flow into the first pressure vessel 44, the emitter inlet valve 736 must be opened and the low-pressure gas system 72 must be activated by opening the low-pressure valve 724 in the low-pressure line 723 of the low-pressure gas supply 721 to the reservoir vessel 41. The emitter material 2 in the reservoir vessel 41 is then pressurized by the gas pressure (100 to 500 kPa) of the low-pressure gas supply 721 and is conveyed via the emitter material line 45 and through the filter 451 into the first pressure vessel 44.

When a desired fill level is reached in the first pressure vessel 44 as measured by a fill level sensor 94, the emitter inlet valve 736 is closed and the filling of the first pressure vessel 44 is concluded.

In order to fill the second pressure vessel 44', the corresponding valves, i.e., the vacuum valve 715', the pressure switching valve 734', the outlet valve 737', the emitter inlet valve 736', and the low-pressure valve 724, are controlled in an analogous manner, but generally counter-cyclically with respect to the first pressure vessel 44. The valve controls are always carried out for valves having the same reference numbers with an added apostrophe as well as for valves which are used universally and which are provided only once.

High-Pressure Operation of the Injection Device 5

The pressure system 7 is controlled by means of the following valve adjustments for generating the droplets 22 in the injection device 5.

The high-pressure valves 733 and 733', the vacuum valves 715 and 715', the pressure switching valves 734 and 734', and the emitter material inlet valves 736 and 736' to the first pressure vessel 44 and second pressure vessel 44' are initially closed. The outlet valves 737 and 737' and the blocking and compensating valve 735 and nozzle inlet valve 738 are also closed initially.

The nozzle 51 is acted upon by the high pressure from the high-pressure gas supply 731 via the emitter material 2 (liquid tin) in that the high-pressure valve 733, the pressure switching valve 734 and the outlet valve 737 of the first pressure vessel 44 and the nozzle inlet valve 738 are opened. The emitter material 2 is then pressed out of the first pressure vessel 44 through the nozzle 51 until a lower threshold of the fill level sensor 94 at the first pressure vessel 44 is reached and the fill level sensor 94 emits a signal.

When the fill level sensor 94 emits a signal, the high-pressure valve 733' and the pressure switching valve 734' to the second pressure vessel 44' are opened. When the pressure in the second pressure vessel 44' is the same as that in the first pressure vessel 44 and this has been measured by the pressure sensors 92 and 92', the outlet valve 737 of the first pressure vessel 44 is closed and the outlet valve 737' of the second pressure vessel 44' is opened.

The nozzle 51 in the injection device 5 is now supplied with emitter material 2 (tin) under high pressure by the second pressure vessel 44'.

The nozzle inlet valve 738 can be closed at any time to interrupt the flow of emitter material through the nozzle 51 when necessary. Accordingly, after interrupting the plasma generation and radiation generation in the EUV source module 1 for reasons relating to application, the pressure regime in the entire pressure system 7 can proceed unaltered without changing the rest of the valve settings.

Continuous Operation

In order to ensure a continuous (uninterrupted) operation of the injection device 5, the first pressure vessel 44 is uncoupled from the high-pressure gas system 73 and from the injection device 5 while the nozzle 51 is being supplied by the second pressure vessel 44' and can accordingly be filled again with emitter material 2.

To this end, the high-pressure valve 733 to the first pressure vessel 44 is closed and the vacuum valve 715 is opened. If necessary, a pressure reducer and/or a pressure relief valve must be installed in the vacuum line 712 so as not to destroy the vacuum pump 711.

As soon as the first pressure vessel 44 has been evacuated, i.e., the final pressure is signalized by the pressure sensor 92, the vacuum valve 715 is closed again and the filling process is initiated as was described above under the heading "Filling process".

The pressure vessels 44 and 44' and the connection line 45 are dimensioned in such a way that the filling process is completed appreciably before the lower threshold of the fill level sensor 94 of the second pressure vessel 44' is reached.

As soon as the fill level sensor 94 signalizes the minimum fill level of the second pressure vessel 44', the valve settings are switched in such a way that the nozzle 51 is again supplied by the first pressure vessel 44 and the second pressure vessel 44' is set to filling mode. The pressure vessels 44 and 44' are advisably dimensioned in such a way that not only can the second pressure vessel 44' be filled during the operating period of the first pressure vessel 44 (and vice versa), but the melt reservoir vessel 41 can also easily be refilled (in longer cycles).

Emitter Material Recycling

Appreciably more emitter material 2 is pressed through the nozzle 51, usually for process-related reasons (owing to a regularly generated chain of droplets), than is required in the plasma generating process (based on the pulse frequency of the energy beam 6). This excess emitter material 24 is captured in a collecting reservoir 81 inside the interaction chamber 13. The feed is shown strictly schematically in FIG. 2. Emitter material 25 (FIG. 1) which is spun off from the rotating electrodes 11 or any unconsumed emitter material 2 which has passed the interaction site without being converted or which is sprayed off by a rotating perforated disk (not shown) to reduce the droplet density can also be received.

At a determined upper fill level in the collecting reservoir 81 which is detected by a fill level sensor 94, the collecting vessel 81 must be at least partially emptied. To this end, when the collecting vessel outlet valve 811, low-pressure valve 725, and recycling return-flow valve 831 are closed, the vacuum valve 716 is opened and the recycling vessel 83 is accordingly evacuated (pressure <2 kPa). To empty the collecting vessel 81, the vacuum valve 716 is closed and the collecting vessel outlet valve 811 is opened. The emitter material 2 (tin) then runs from the collecting vessel 81 inside the interaction chamber 13 (high vacuum $10^{-2}$ to 50 Pa) into the recycling vessel 83 outside the interaction chamber 13 by gravitational force. The emitter material 2 can then be returned to the circuit.

For this purpose, the reservoir vessel 41 is evacuated by the vacuum valve 714. The recycling vessel 83 is pressurized by opening the low-pressure valve 725 with closed collecting vessel outlet valve 811 and vacuum valve 716 at the recycling vessel 83. By opening the recycling return-flow valve 831, the emitter material 2 is then conveyed out of the recycling vessel 83 into the reservoir vessel 41, where it is available for filling the two pressure vessels 44 and 44' (as was described above) and, therefore, for injection once again into the interaction chamber 13 through the nozzle 51 of the injection device 5.

The sensor functions in the two pressure vessels 44 and 44' are particularly essential for the continuous supply of emitter material 2 under stable pressure.

A first magnitude to be measured is the fill level measurement in all of the vessels 41, 44, 44', 81 and 83 for the emitter material 2 contained therein. For this purpose, different variants are shown in FIGS. 3-7.

Figure 3:
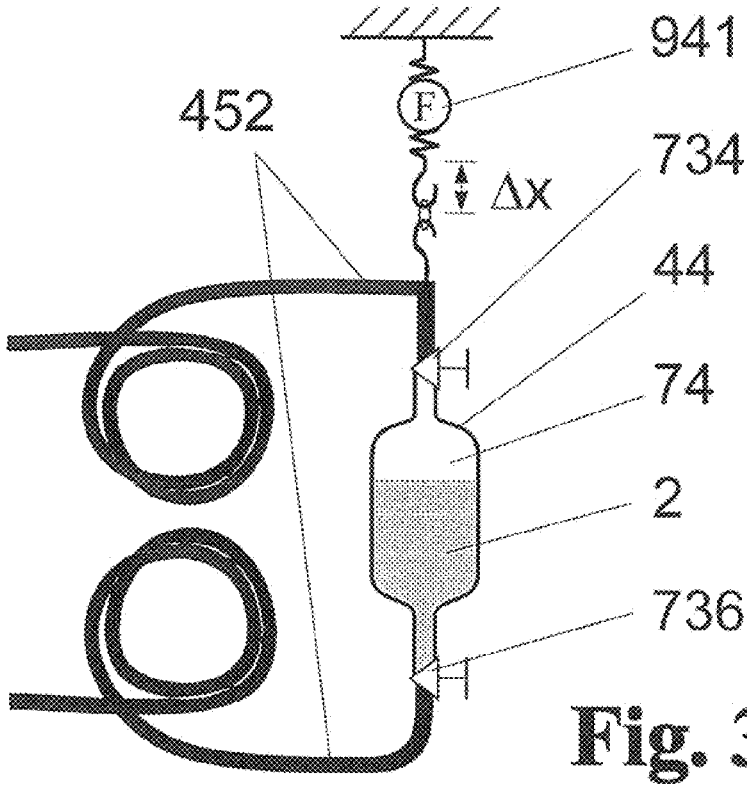
FIG. 3 shows a variant of fill level measurement by weighing.
Figure 4:
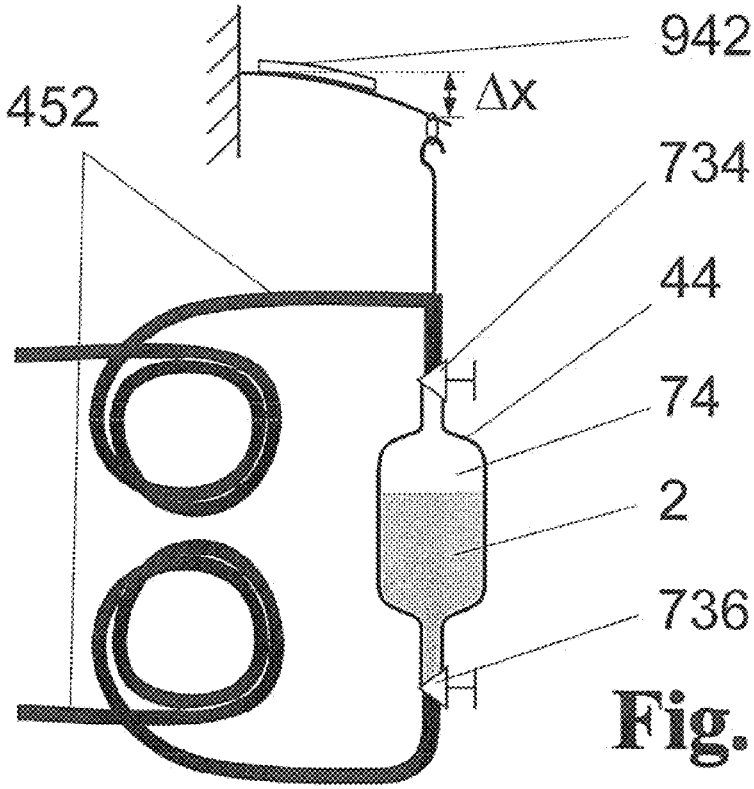
FIG. 4 shows a variant of fill level measurement though determining a weight equivalent by means of strain gauge attached to an one-side clamped flexural spring.

FIG. 3 and FIG. 4 show technical implementations of fill level sensors 94 based on the principle of weight measurement and are shown for a first pressure vessel 44 without limiting applicability to all other emitter material vessels.

For this type of fill level measurement, the stiffness of all of the vessel connections (pressure lines and emitter material feed lines and discharge lines) must be reduced by means of flexible lines 452 in such a way that a certain vertical displacement $\Delta x$ is made possible for the weight measurement. Stiffness can be reduced, for example, by helical tube shapes and/or by an appropriate choice of material or structure.

Measurement of the weight of the emitter material 2 in the pressure vessel 44 is carried out, according to FIG. 3, by means of a spring dynamometer 941 which offers sufficient accuracy, e.g., for heavy metallic zinc.

In a substantially higher-resolution embodiment form according to FIG. 4, the pressure vessel 44 is suspended at the free end of a flexural spring which is fixedly clamped on one side and whose flexing by means of a strain gauge 942 provides a weight equivalent.

Figure 5:
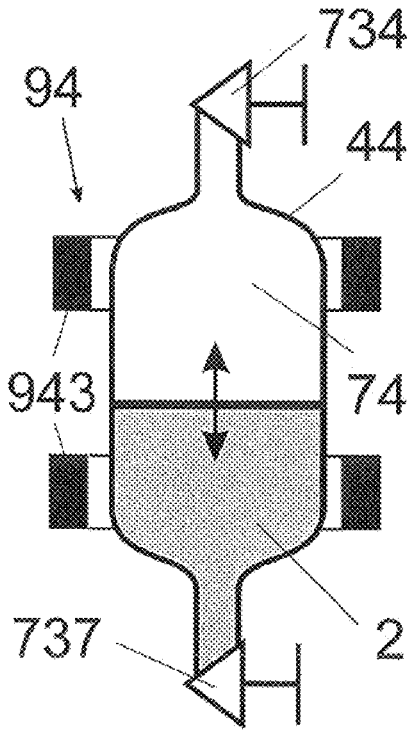
FIG. 5 shows a variant of fill level measurement by induction.

Another technical embodiment of the fill level measuring means according to FIG. 5 uses a sensor which measures the inductance of the pressure vessel 44, including the metallic emitter material 2. For this purpose, an inductive fill level measuring device 943 in the form of two coils is arranged outside the pressure vessel 44 and acquires the change in inductance depending on the fill level of the pressure vessel 44 as a measure of the fill level of the vessel 44.

Figure 6:
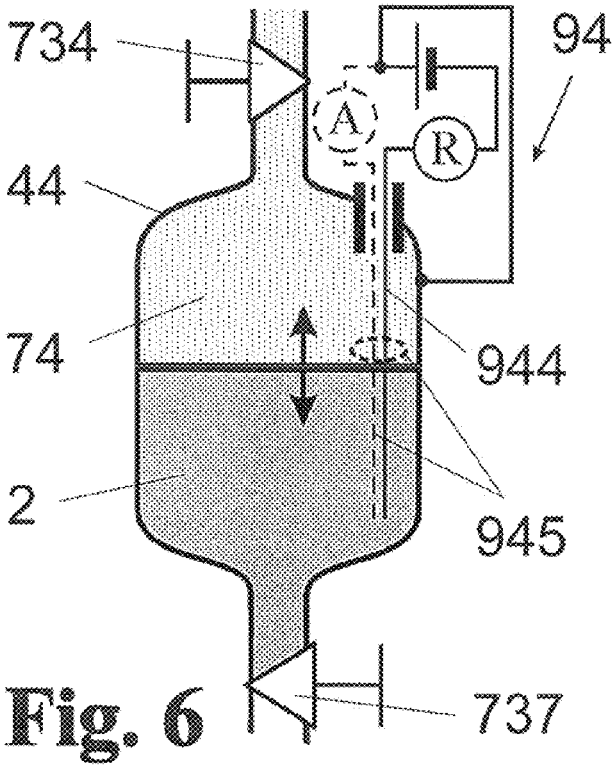
FIG. 6 shows a variant of fill level measurement using a resistance wire (resistance measurement) and optionally measuring the displacement current.

FIG. 6 shows another possibility for fill level measurement which has a resistance wire 944 which shows a higher resistance as the fill level decreases when liquid metal is used as emitter material 2 (e.g., tin).

As is indicated by the dashes, this construction can be modified to form a capacitive fill level measuring device 945 in that a low-impedance collector path is arranged parallel to the high-impedance resistance wire 944, and a coupling electrode in the form of an annulus floats on the surface of the emitter material 2—or is integrated in separating means 46, if provided (see below, FIGS. 8-11)—so as to enclose the collector path and the resistance wire 944 and provides for a spatially dependent displacement current from the resistance wire 944 to the collector path in a capacitive, noncontacting manner. The displacement current represents a measure of the fill level of the pressure vessel 44.

When metallic tin is used as emitter material 2, it is sufficient for the operation of the emitter material supply unit 4 to let the fill level of all of the tin-filled vessels be indicated by metal contacts 946 in that the liquid metal closes the connection in the separate contact circuits.

Figure 7:
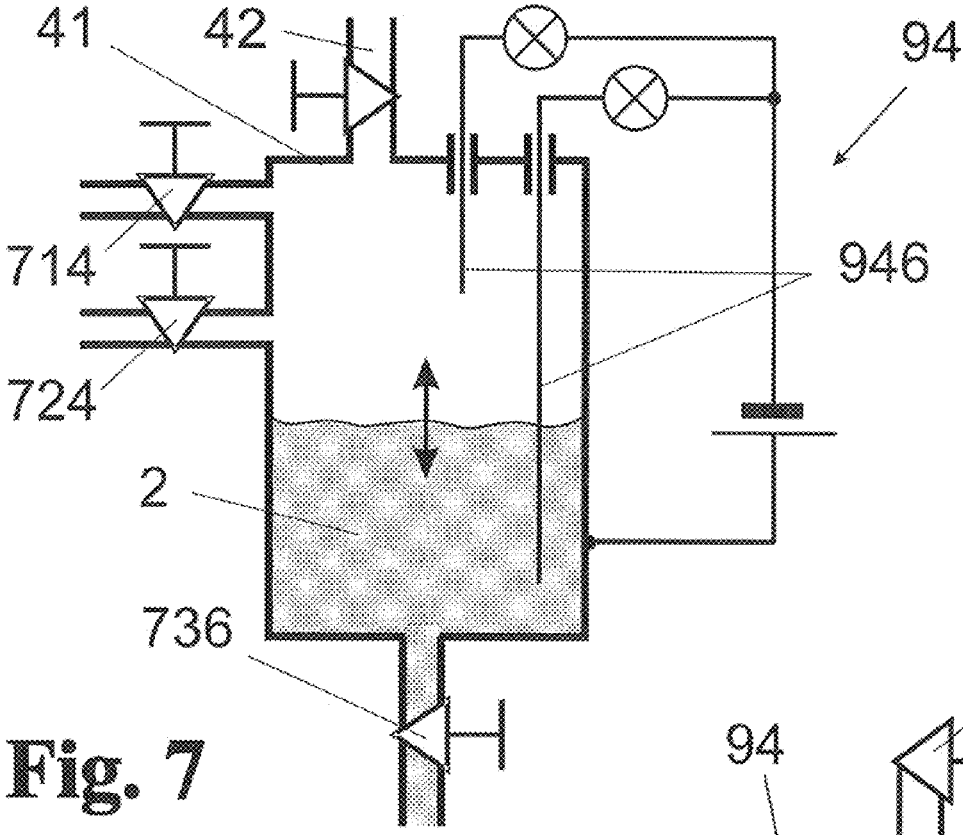
FIG. 7 shows a variant of fill level measurement using contacts for detecting threshold values of an upper and a lower fill level.

For example, in the technical embodiment of the fill level measuring device shown in FIG. 7, the electrically conductive property of the tin is made use of to acquire a signal when arriving at the upper and/or lower contact 946 as threshold values for the fill level in the reservoir vessel 41. Two contacts 946 are arranged at an upper fill level and a lower fill level in the vessel which is represented as a reservoir vessel 41 without limiting applicability to other vessels and which contains liquid tin. Depending on the fill level, either no contact 946 is closed (fill level is below the lower level), one contact 946 is closed (fill level is between the lower and upper levels), or both contacts 946 are closed (fill level is above the upper level).

In order to realize a continuous fill level measurement, the long contact 946 for detecting the lower fill level can also be realized in the form of a bare resistance wire 944. The actual fill level of the vessel 44 (corresponding to the description of FIG. 6) can then be arrived at by measuring the resistance.

In spite of the constant pressurization ensured by the coupling of alternately operating pressure vessels 44 and 44', another considerable problem arises for constant generation of droplets from the nozzle 51 of the emitter material injection device 5.

As a result of the pressurization of the emitter material 2 (e.g., tin) by an inert gas ($N_2$, Ar, He, Ne . . . ) under high pressure, gas is dissolved to a considerable extent even in a liquefied metal such as tin.

Henry's law states that the amount of a dissolved gas in a liquid is proportional to the gas pressure over the liquid. A very high pressure from 1 to tens of megapascals (1 to 50 MPa) is required for the desired velocity of the droplets 22 in the interaction chamber 13, so that a correspondingly large amount of pressure gas 74 dissolves in the emitter material 2 (tin). When the liquid flows out in a vacuum, the dissolved gas is released again immediately in large part. When tin, as emitter material 2, is sprayed out through the nozzle 51 into the vacuum of the interaction chamber 13, there are sharp drops in pressure at the nozzle output and at the nozzle input due to cavitation. The gas which is thereby released leads to the formation of gas bubbles and adversely affects the forming of droplets and the positional stability of the liquid jet exiting from the nozzle 51.

In order to prevent this instability in the regular series of droplets 22 generated in the injection device 5, steps are described in the following for reducing or completely preventing the dissolving of the pressure gas 74 in the liquid emitter material 2 (tin) inside the pressure vessels 44 and 44'.

Figure 8:
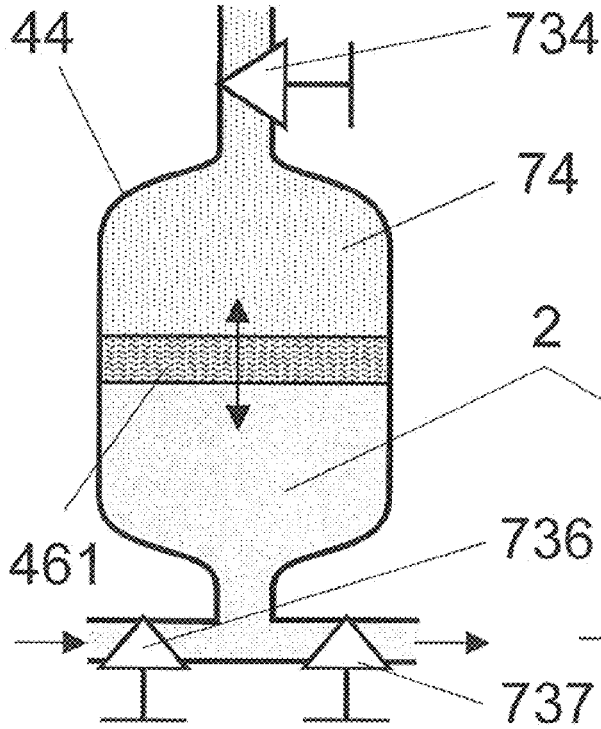
FIG. 8 shows an embodiment form for separating emitter material and pressure gas by means of a liquid barrier layer.

FIG. 8 shows a possible variant for preventing direct contact between the pressure gas 74 and the emitter material 2. To this end, a barrier layer 461 of viscous liquid is applied to the emitter material 2 inside the pressure vessels 44 and 44' (only shown in FIG. 2). This barrier layer 461 (barrier liquid) must be made of a material which has a lower density than the emitter material 2 but which does not chemically react with, or mix with, the emitter material 2. One possibility is to use a cover oil such as is used in the electronics industry for preventing oxidation.

Figure 9:
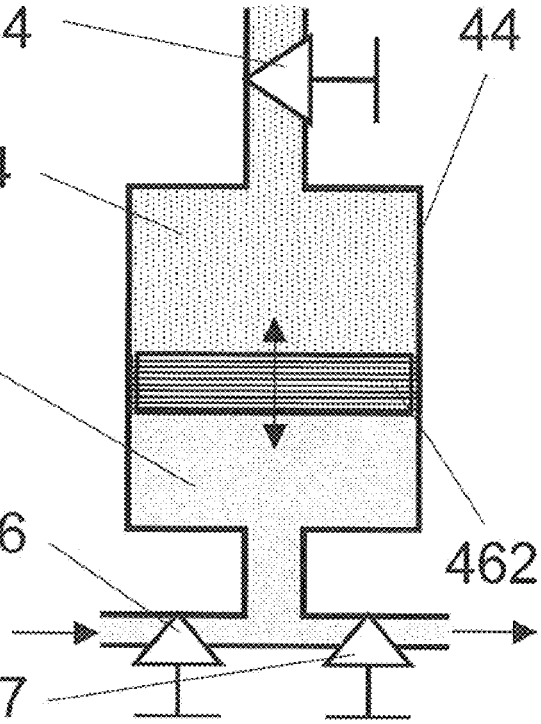
FIG. 9 shows an embodiment for separating emitter material and pressure gas by means of a floating piston.

A more reliable variant for separating the pressure gas 74 from the emitter material 2 is shown schematically in FIG. 9. In this example, a piston 462 is arranged between the emitter material 2 and the pressure gas 74. The piston 462 slides up and down in the cylindrical pressure vessel 44 and accordingly transmits the pressure from the pressure gas 74 (inert gas) to the emitter material 2 while simultaneously separating the pressure gas 74 from the liquid emitter material 2.

Figure 10:
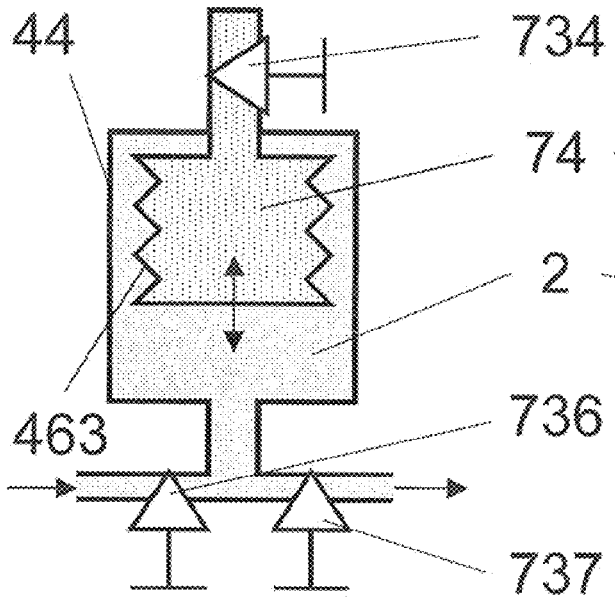
FIG. 10 shows a variant for separating emitter material and pressure gas by means of bellows, wherein the displacement of emitter material is carried out by volume variation of the gas-filled bellows.
Figure 11:
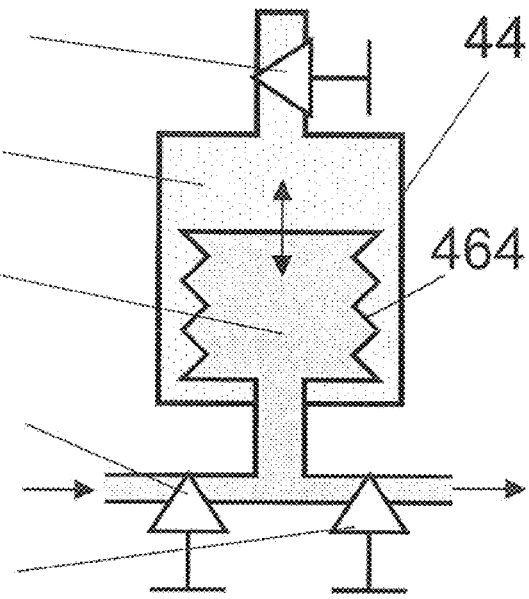
FIG. 11 shows a variant for separating emitter material and pressure gas by means of bellows, wherein the displacement of emitter material is carried out by pressure variation within the pressure vessel to compress the emitter material-filled bellows.

FIGS. 10 and 11 show other variants for preventing the penetration of the pressure gas 74 into the liquid emitter material 2 which make it possible to separate them completely.

In this case, an enclosed membrane which is resilient to pressure and can change an enclosed volume is located inside the pressure vessel 44. To increase the change in volume, the membrane can be constructed in the form of a convoluted or corrugated bellows 463, 464.

In FIG. 10, a bellows 463 supplies a volume which is closed for the pressure gas 74 and with its entire surface forms the separating means 46 between the emitter material 2 and pressure gas 74. Inside the pressure vessel 44, owing to the elasticity of the bellows 463, the gas pressure resulting from the displacement of liquid will predominate over the bellows 463 which is filled with emitter material 2. Even at very high pressures of more than 10 MPa, the pressure difference between the gas volume inside the bellows 463 and outside in the pressure vessel 44 is very slight. The pressure difference results merely from the force necessary for a defined change in volume during the elastic deformation of the bellows 463 (membrane). The operating principle is comparable to that of the piston 462 according to FIG. 9, but, compared to the piston 462, the separation effected by the bellows 463 (or membrane) is complete and substantially more reliable so that ordinary air can be used in place of inert gas as a pressure gas 74.

FIG. 11 shows an embodiment form which is identical to that shown in FIG. 10 but in inverted form. In this case, a bellows 464 (or membrane) filled with liquid emitter material 2 is provided and the pressure gas 74 streams into the pressure vessel 44 outside the bellows 464 filled with emitter material 2.

After the stability of the pressurized emitter material 2 has been established by preventing a solubility of the pressure gas 74, it reaches the emitter material injection device 5. This emitter material injection device 5 comprises a nozzle 51 which is outfitted with means for exciting droplet breakup and which delivers the liquid emitter material 2 supplied via a nozzle feed line 52 as a regular series of droplets 23 to a droplet selection chamber 53. A droplet selector 54 is provided for selecting individual droplets 22 (e.g., every tenth droplet) from the series of droplets generated by the nozzle 51.

Figure 12:
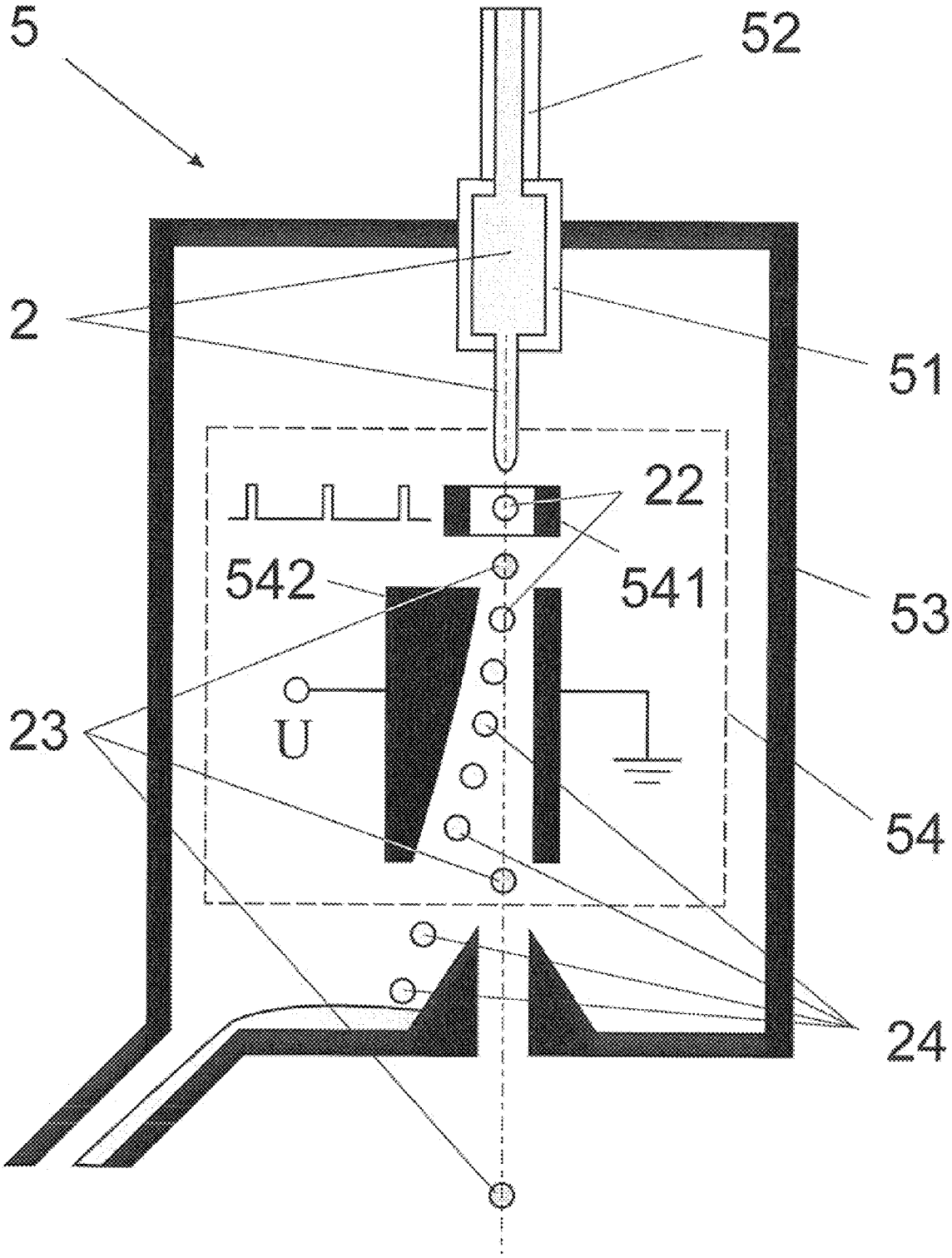
FIG. 12 shows an embodiment of the invention with separation of the mass flow of emitter material in two directions for excitation in the interaction chamber and for recycling in the emitter material circuit.

In this example shown in FIG. 12, the droplet selector 54 has a charging electrode 541 followed by two deflecting electrodes 542 which deflect a majority of the droplets 22 as excess droplets 24 and do not influence individual selected droplets 22. These selected droplets 22 provide the series of droplets 23 that is synchronized with the pulses of the energy beam 6. The selection of droplets 22 is carried out as needed for plasma generation (for every seventh droplet 22 in the present example) in that all unneeded, excess droplets 24 are charged by a voltage pulse as they fly through the charging electrode 541 and are deflected through the subsequent section of deflecting electrodes 542 between which an electric field is formed. In this way, a majority of the emitter material 2 is deflected and is guided via a collecting reservoir 81 to a recycling vessel 83 downstream. Accordingly, this unconsumed emitter material 2 can be returned to circulation and is again available in the reservoir vessel 41.

While this invention has been particularly shown and described with references to preferred embodiments thereof, it will be understood by those skilled in the art that various changes in form and details may be made therein without departing from the scope of the invention encompassed by the appended claims.

What is claimed is:

1. An arrangement for generating EUV radiation based on a hot plasma using a liquid emitter material comprising:

an emitter material supply unit comprising at least one reservoir vessel for the emitter material, the emitter material supply unit having at least a first pressure vessel and a second pressure vessel between the reservoir vessel and an injection device for generating a high emitter material pressure for an injection unit in that the pressure vessels are acted upon by a high-pressure gas system with a gas pressure in a megapascal range in order to maintain a constant emitter material pressure in the injection device, the emitter material supply unit comprising means for switching the high-pressure gas system from one pressure vessel to the other pressure vessel and for correspondingly alternately switching the injection unit to the constant emitter material pressure of the respective pressure vessel being pressurized, wherein at least one of the pressure vessels can be refilled with the emitter material from the reservoir vessel during continuous operation of droplet generation and plasma generation;

an evacuated interaction chamber in which a focused, pulsed energy beam is directed to an interaction point; and the injection device for reproducibly supplying droplets of the emitter material at the interaction point so as to be synchronized with the pulsed energy beam in order to convert the droplets into hot plasma for EUV emission.

2. The arrangement according to claim 1, wherein the emitter material supply unit is further connected to a vacuum system which is selectively connected to at least one of the pressure vessels that is not enabled for the high-pressure gas system in order to fill with the emitter material from the reservoir vessel.

3. The arrangement according to claim 2, wherein the vacuum system in the emitter material supply unit is connected to the reservoir vessel to allow the reservoir vessel to be filled from different sources.

4. The arrangement according to claim 3, wherein the reservoir vessel can be filled by sucking in liquid emitter material from the outside.

5. The arrangement according to claim 3, wherein the reservoir vessel can be filled by sucking liquid emitter material from a recycling vessel.

6. The arrangement according to claim 3, wherein the reservoir vessel can be filled by sucking in solid emitter material from the outside.

7. The arrangement according to claim 2, wherein the emitter material supply unit is connected to a low-pressure gas system which is selectively connected to the reservoir vessel or to the recycling vessel to transfer emitter material from the reservoir vessel to one of the pressure vessels or to fill it with recycled emitter material.

8. The arrangement according to claim 1, wherein the low-pressure gas system is filled with inert gas in order to counter oxidation of the emitter material.

9. The arrangement according to claim 1, further comprising fill level sensors are provided in the emitter material supply unit for measuring the fill level of at least the pressure vessels, which fill level sensors control a timely switching of the pressurization of the emitter material from one of the pressure vessels to another pressure vessel and initiate the filling of the respective empty pressure vessel.

10. The arrangement according to claim 9, wherein the fill level sensor is constructed as a dynamometer and the fill level can be determined based on the weight of the respective vessel, wherein the respective vessel is suspended at the dynamometer and has flexible connection lines.

11. The arrangement according to claim 9, wherein the fill level sensor is constructed as a strain gauge wherein the vessel is suspended at the free end of a flexural spring which is fixedly clamped at one side and provided with the strain gauge and has flexible connection lines, and the fill level can be determined based on the weight of the respective vessel and the strain of the strain gauge.

12. The arrangement according to claim 9, wherein the fill level sensor is constructed as an inductive fill level measuring device comprising two external cylinder coils.

13. The arrangement according to claim 9, wherein the fill level sensor is a resistance wire, wherein the vessel that is filled with metal emitter material serves as an electric line to the resistance wire which is arranged vertically in the vessel so as to be electrically insulated.

14. The arrangement according to claim 9, wherein the fill level sensor is designed as a capacitive fill level measuring device with resistance wire, coupling electrode, and collector path, wherein the coupling electrode, which is shaped as an annulus, is moved along with the liquid level of the emitter material) so as to float around the resistance wire and the collector path.

15. The arrangement according to claim 9, wherein the fill level sensor has two electrically insulated contacts of different length, wherein the electric contacts are closed by means of the metal emitter material at different fill levels to indicate a minimum and maximum fill level.

16. The arrangement according to claim 1, wherein the emitter material supply unit has separating means inside the pressure vessel for separating the emitter material) from the pressure gas, which reduces the dissolution of pressure gas in the emitter material.

17. The arrangement according to claim 16, wherein the separating means are formed by a barrier layer.

18. The arrangement according to claim 17, wherein the barrier layer is formed by a viscous cover oil.

19. The arrangement according to claim 16, wherein the separating means are formed by a piston which can move up and down in a cylindrical pressure vessel.

20. The arrangement according to claim 16, wherein the separating means are provided as a flexible membrane.

21. The arrangement according to claim 20, wherein the flexible membrane is formed as convoluted or corrugated bellows which are filled with pressure gas.

22. The arrangement according to claim 20, wherein the flexible membrane is formed as convoluted or corrugated bellows filled with emitter material.

23. The arrangement according to claim 21, wherein the convoluted or corrugated bellows are constructed as metal bellows.

* * * * *